US006772672B2

(12) United States Patent
Kosugi et al.

(10) Patent No.: US 6,772,672 B2
(45) Date of Patent: Aug. 10, 2004

(54) ACTUATOR HOLDING STRUCTURE FOR VEHICLE

(75) Inventors: Kazuhiro Kosugi, Nagano-ken (JP); Shinji Oka, Saitama (JP); Toru Ishino, Saitama (JP)

(73) Assignees: Nissin Kogyo Co., Ltd., Nagano-Ken (JP); Honda Giken Kogyo Kabushiki Kaisha, Tokyo (JP)

( * ) Notice: Subject to any disclaimer, the term of this patent is extended or adjusted under 35 U.S.C. 154(b) by 62 days.

(21) Appl. No.: 10/346,093

(22) Filed: Jan. 17, 2003

(65) Prior Publication Data

US 2003/0136255 A1 Jul. 24, 2003

(30) Foreign Application Priority Data

Jan. 18, 2002 (JP) ..... P. 2002-009757

(51) Int. Cl.[7] ..... F15B 15/26
(52) U.S. Cl. ..... 92/23; 60/533
(58) Field of Search ..... 92/128, 23, 129; 60/533

(56) References Cited

U.S. PATENT DOCUMENTS 285,385 A * 9/1883 Brundage ..... 215/280
4,454,632 A * 6/1984 Nix et al. ..... 92/23
4,557,361 A * 12/1985 Nix et al. ..... 92/23
4,581,979 A * 4/1986 Compton et al. ..... 92/23
4,665,802 A * 5/1987 Barker et al. ..... 60/533
4,766,804 A * 8/1988 Barker ..... 60/533
5,002,169 A * 3/1991 Barker ..... 92/23
6,460,449 B2 * 10/2002 Higuchi et al. ..... 92/23

FOREIGN PATENT DOCUMENTS

JP 2001-289206 10/2001

* cited by examiner

*Primary Examiner*—Edward K. Look
*Assistant Examiner*—Michael Leslie
(74) *Attorney, Agent, or Firm*—McGuireWoods LLP

(57) ABSTRACT

An actuator holding structure for a vehicle has: a first retainer attached to the housing; a second retainer attached to the piston rod; and, a plurality of protruded engaging portions formed on the outer peripheral surface of the housing, wherein the piston rod is held in the retracted condition while the first retainer and the second retainer are engaging together, and when the first retainer is released from engaging with the second retainer, and the piston rod is allowed to be extended and retracted, wherein the first retainer includes a first lateral belt for peripherally holding a part of the housing by engaging with the protruded engaging portions while the first retainer and the second retainer are engaging together, and a second lateral belt for peripherally holding the other part of the housing opposite to the first lateral belt so as to be latched and unlatched.

8 Claims, 5 Drawing Sheets

ACTUATOR HOLDING STRUCTURE FOR VEHICLE

BACKGROUND OF THE INVENTION

1. Field of the Invention

The present invention relates to a vehicle actuator holding structure for holding the piston rod of an actuator in a retracted condition, the actuator including a slave cylinder for use in operating a vehicle brake or clutch.

2. Description of the Related Art

Clutch master cylinders and slave cylinders are used in clutches as actuators in four-wheeled vehicles and when such a clutch is consigned to manufacturers, piping is employed beforehand for coupling the clutch master cylinder and the slave cylinder as a clutch piping system in such a condition that the clutch piping system has substantially been incorporated into a vehicle before being consigned to assembly manufacturers with the clutch piping system filled with working fluid.

The slave cylinder in the actuator is so constructed as to retract a piston rod through its housing by means of hydraulic fluid moving from the clutch master cylinder as a fluid-pressure generating source. In the pre-filled condition above, the piston rod is held in the retracted condition in the holding structure so that the piston rod is prevented from producing any backlash. Japanese Patent Laid-Open No. 2001-289206 discloses one of the examples as described above.

The holding structure has a first retainer attached to the housing of an actuator and a second retainer attached to a piston rod retractably contained in the housing. The first retainer includes a substantially annular assembly attached to a housing side opposite to the piston rod, a plurality of coupling leg pieces extending from the assembly toward the front end of the piston rod along the side of the housing, a first engaging portion formed at the front end of each coupling leg piece, and a lateral belt for coupling the plurality of coupling leg pieces by peripherally carrying the piston-rod side of the housing with its arm. A rupture portion is formed in the assembly and the lateral belt both and a second engaging portion is provided to the second retainer.

The retracted condition of the piston rod is held by joining the first engaging portion of the first retainer and the second engaging portion or the second retainer. When the first retainer is released from engaging with the second retainer by removing the first retainer from the housing, the piston rod is allowed to be extended and retracted.

However, as the first retainer used in the holding structure above is arranged such that the assembly is attached to the side of the housing opposite to the piston rod and that the lateral belt is attached to the piston rod side of the housing, the assembly and the lateral belt are coupled together by the use of the plurality of coupling leg pieces so as to form the external configuration of the housing accordingly. As a result, it is not feasible to appropriate the holding structure to any other housing different in configuration and a number of special parts are needed to be prepared for individual housings, which has resulted in lower productivity, safe-keeping capacity and economic efficiency.

SUMMARY OF THE INVENTION

An object of the present invention is to provide an actuator holding structure for a vehicle, capable of being widely employed for many kinds of actuators different in configuration when the actuator for use in a vehicle brake or clutch is set in a pre-filled condition before the actuator is incorporated into the vehicle.

In order to accomplish the object above, there is provided An actuator holding structure for a vehicle, holding a piston rod retractably contained in a housing of an actuator in such a manner that the piston rod is held in the housing in a retracted condition and while the actuator is in operation, the retracted condition of the piston rod is released so that the piston rod is allowed to be extended and retracted, having: a first retainer attached to the housing; a second retainer attached to the piston rod; and, a plurality of protruded engaging portions formed on the outer peripheral surface of the housing, wherein the piston rod is held in the retracted condition while the first retainer and the second retainer are engaging together, and when the first retainer is released from engaging with the second retainer, and the piston rod is allowed to be extended and retracted, wherein the first retainer includes a first lateral belt for peripherally holding a part of the housing by engaging with the protruded engaging portions while the first retainer and the second retainer are engaging together, and a second lateral belt for peripherally holding the other part of the housing opposite to the first lateral belt so as to be latched and unlatched.

Further, the first retainer may be disposed in the vicinity of the retractable side of the piston rod of the housing, wherein a plurality of coupling leg pieces are projected from one of the first and second retainers, the coupling leg piece having a first engaging portion, whereas a second engaging portion for latching and unlatching the first engaging portion is provided to the other retainer. The first lateral belt may include a rupture portion for breaking apart the first retainer when the first retainer is removed. The first retainer may include a connection piece coupling both ends of the first lateral belt so as to keep the engaged condition of the second lateral belt when the first retainer is removed.

DETAILED DESCRIPTION OF THE PREFERRED EMBODIMENTS

A description will now be described of an embodiment of the present invention applied to the slave cylinder of a vehicle clutch with reference to the drawings.

Figure 1:
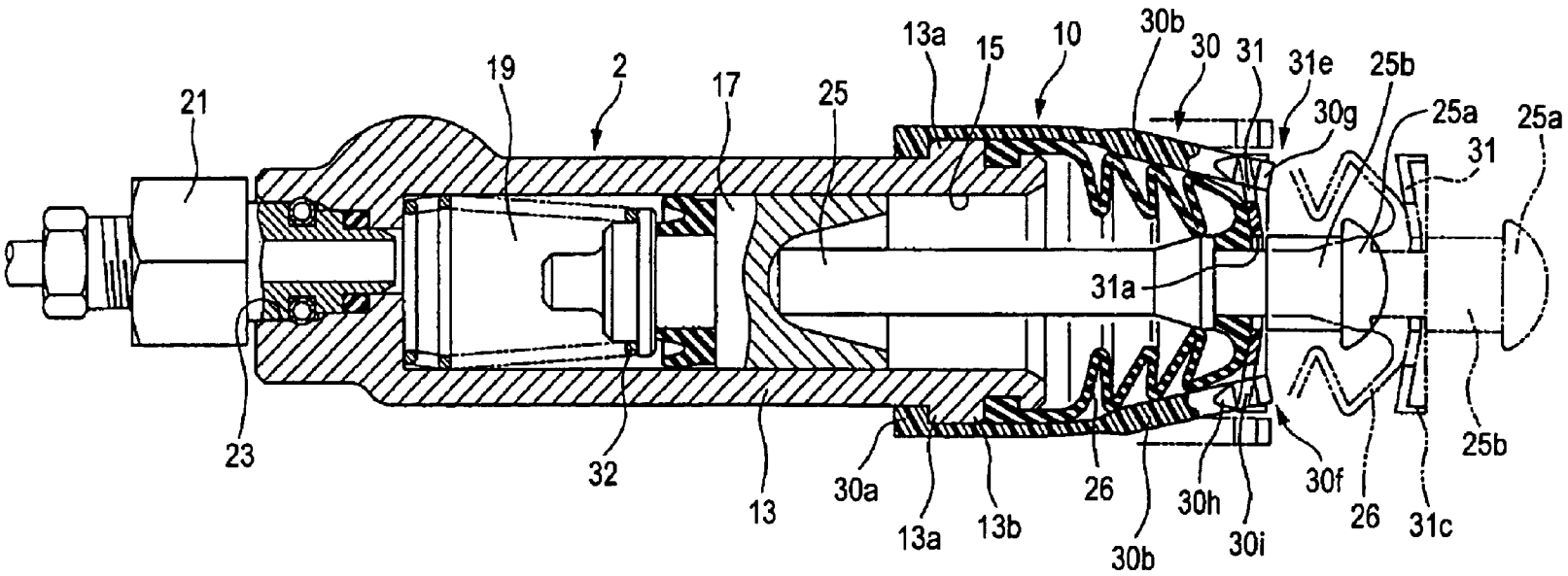
FIG. 1 is a sectional elevation of a slave cylinder whose piston rod is retracted by a holding means embodying the present invention.
Figure 2:
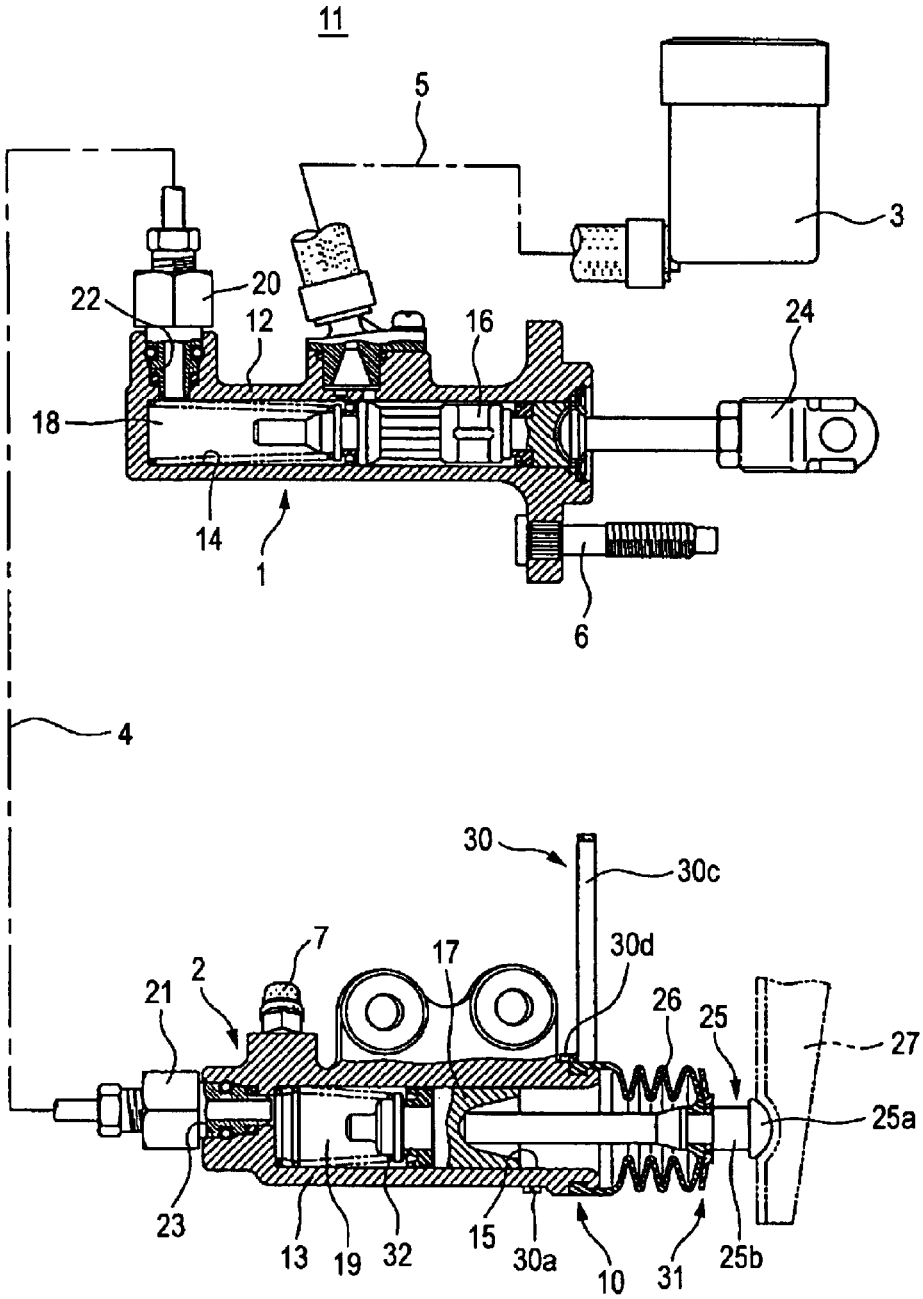
FIG. 2 is a schematic diagram of a clutch piping system using the slave cylinder.
Figure 3:
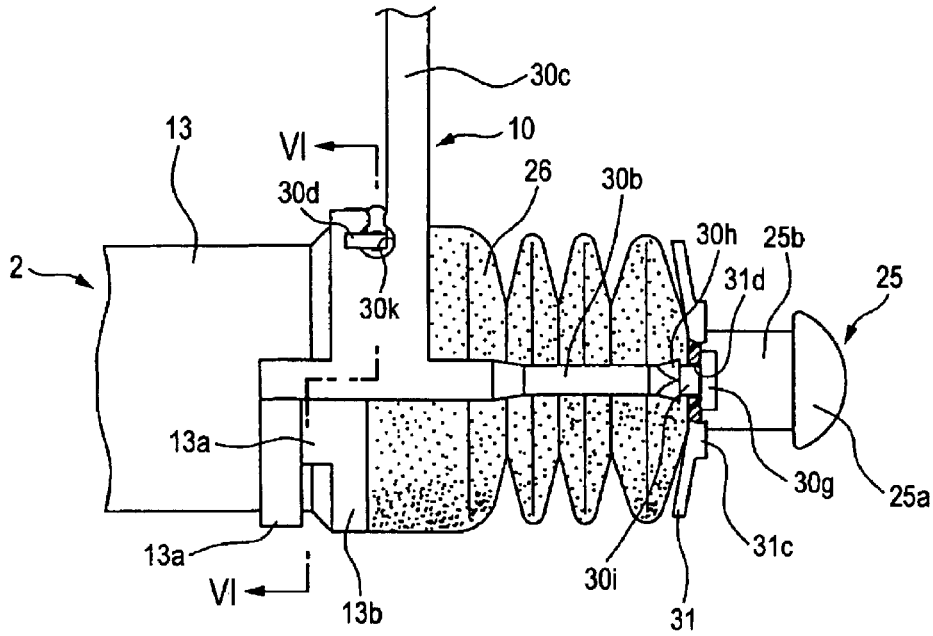
FIG. 3 is an elevation of the principal part of FIG. 2.
Figure 4:
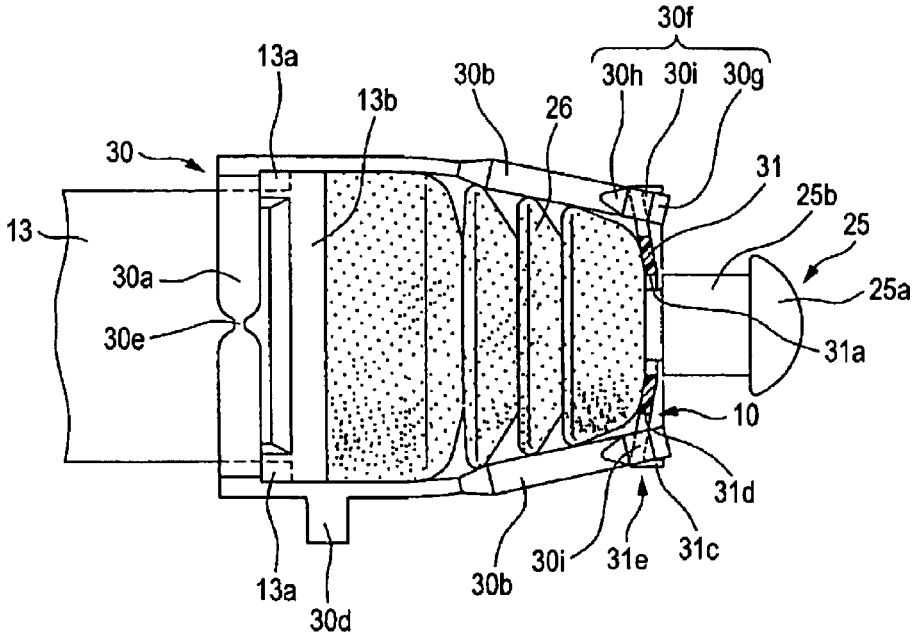
FIG. 4 is a bottom view of FIG. 3.
Figure 5:
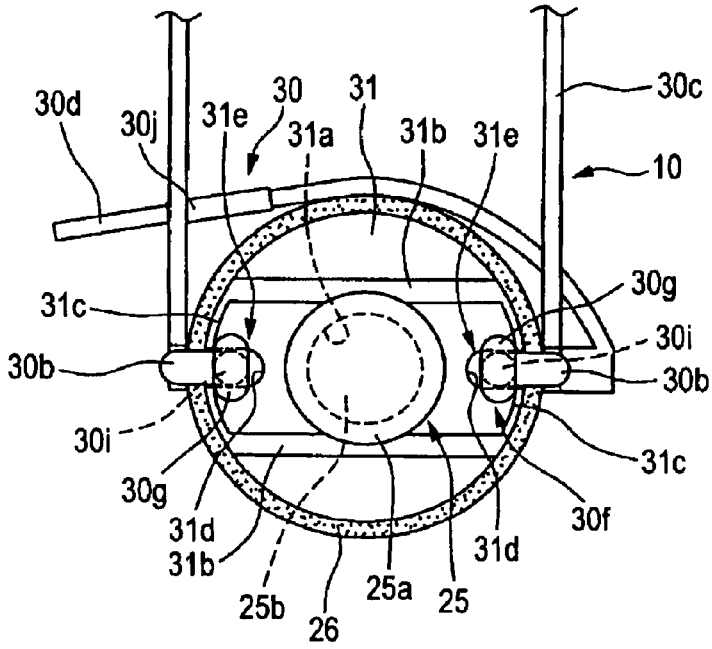
FIG. 5 is a right-side view of FIG. 3.
Figure 6:
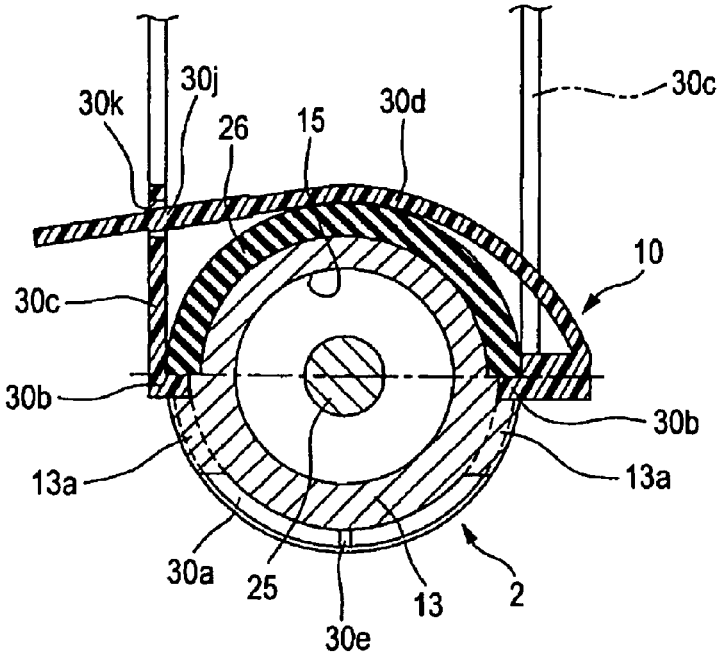
FIG. 6 is a sectional view taken on line VI—VI of FIG. 3.
Figure 7:
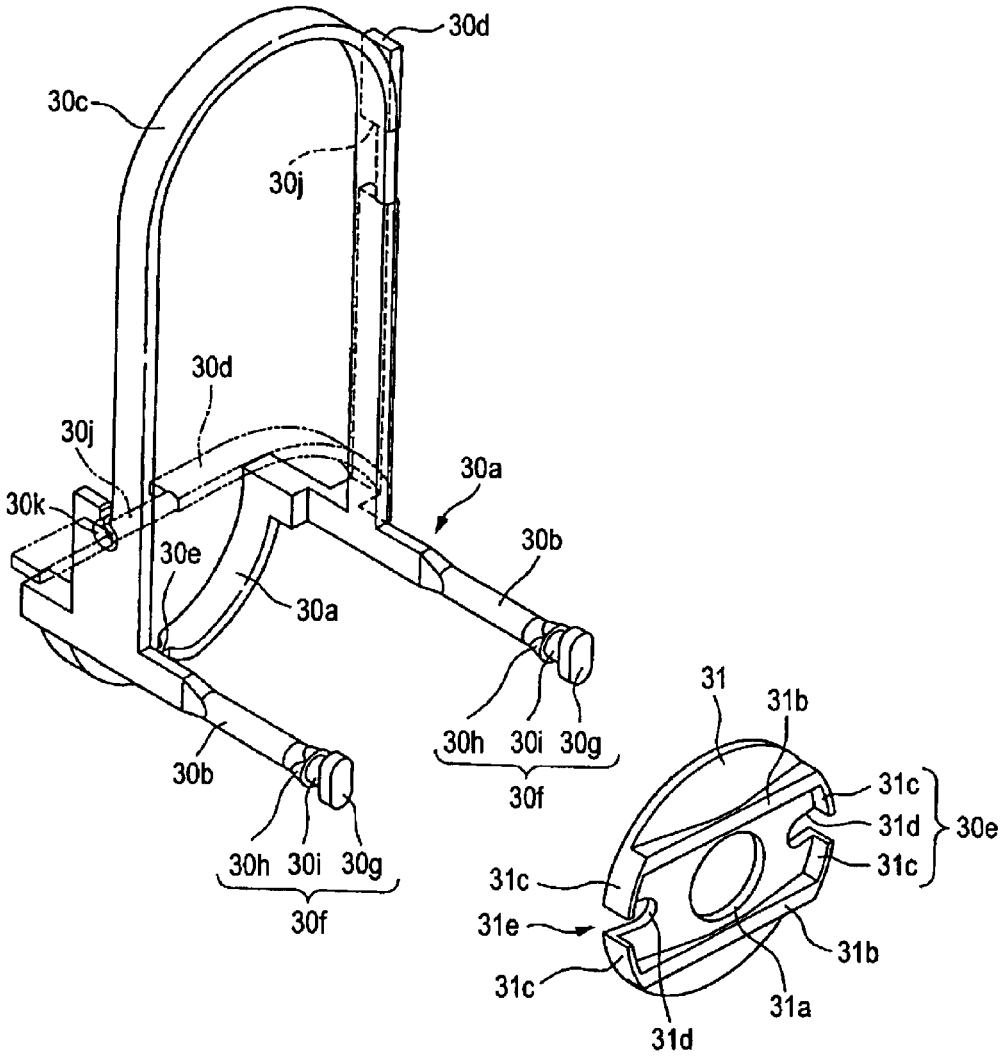
FIG. 7 is an exploded perspective view of a first and a second retainer.

In the drawings, FIG. 1 is a sectional elevation of a slave cylinder whose piston rod is retracted by a holding means; FIG. 2, a schematic diagram of a clutch piping system; FIG. 3, an elevation of the principal part of FIG. 2; FIG. 4, a bottom view of FIG. 3; FIG. 5, a right-side view of FIG. 3; FIG. 6, a sectional view taken on line VI—VI of FIG. 3; and FIG. 7, an exploded perspective view of retainers.

A clutch master cylinder 1 and a slave cylinder 2, together with a reservoir 3 for the clutch master cylinder, in a vehicle clutch are as shown by a solid line in FIG. 2 connected via pipes 4 and 5 beforehand on the part of actuator manufacturers. Further, fittings such as a mounting bolt 6, a bleeder screw 7, a holding means 10 as described later and so forth constituting a clutch piping system 11 in a ready-for-assembly condition are installed before being consigned from actuator manufacturers to assembly makers in such a pre-filled condition that hydraulic fluid is filled in the system ranging from the reservoir 3 up to the slave cylinder 2.

The clutch master cylinder 1 and the slave cylinder 2 are basically arranged so as to commonly form a hydraulic cylinder and respectively have cylinder bodies 12 and 13 with closed-end cylinder bores 14 and 15 therein, pistons 16 and 17 liquid-tightly and movably fitted in the cylinder bores 14 and 15, and hydraulic chambers 18 and 19 sectioned in the base portions of the cylinder bores 14 and 15.

The hydraulic chambers 18 and 19 of the cylinders 1 and 2 are coupled by respectively screwing union bolts 20 and 21 provided at the ends of the pipe 4 into union bores 22 and 23. A piston rod 24 is flexibly inserted into the opening side of the cylinder bore 14 of the clutch master cylinder 1, whereas a piston rod 25 is flexibly inserted into the opening side of the cylinder bore 15 of the slave cylinder 2.

Approximately half the piston rod 25 of the slave cylinder 2 is held in the cylinder bore 15 and the inner end of the piston rod 25 is brought into contact with a piston 17. A protective boot 26 is attached so as to provide an outside covering between the retractable side end of the piston rod 25 of the cylinder body 13 and the projected portion of the piston rod 25. After the slave cylinder 2 is incorporated into a vehicle body, a clutch release fork 27 is provided such that its front end is kept in contact with the outer-end head portion 25*a* of the piston rod 25.

The holding means 10 is employed for the slave cylinder 2 in the pre-filled condition and the slave cylinder 2 is held with the piston rod 25 retracted by the holding means 10 in the direction of a housing. The holding means 10 includes a first plastic retainer 30 attachable to and detachable from the cylinder body 13, a second plastic retainer 31 attached to the projected portion of the piston rod 25 and a pair of protruded engaging portions 13*a* and 13*a* formed on the respective outer peripheral surfaces of the cylinder body 13.

The first retainer 30 includes a first, substantially semi-circular arc shaped lateral belt 30*a*, a pair of coupling leg pieces 30*b* and 30*b* projecting in parallel from both ends of the first lateral belt 30*a* toward one side thereof, a connection piece 30*c* protruding opposite to the first lateral belt 30*a* so as to connect the vicinity of the base ends of the coupling leg pieces 30*b* and 30*b*, and a second lateral belt 30*d* integrally formed with the base of the connection piece 30*c*.

The first lateral belt 30*a* is formed so as to have the substantially same diameter as that of the cylinder body 13 and the intermediate portion of the first lateral belt 30*a* is provided with a slender rupture portion 30*e*. A first engaging portion 30*f* is provided at the front end of each coupling leg piece 30*b*. A first elliptic stopper 30*g* is also provided at the front end of the coupling leg piece 30*b* in parallel to the direction in which the connection piece 30*c* is projected and a second stopper 30*h* is protruded from the first stopper 30*g* in the position separated by a space slightly wider than the thickness of the second retainer 31, so that a engaging shaft 30*i* is formed between both the stoppers 30*g* and 30*h*.

As the connection piece 30*c* serves as a knob for removing the first retainer, the connection piece 30*c* is slightly wider than the first lateral belt 30*a* and formed into a half-ellipse so that the first lateral belt 30*a* has a linear portion. When the first retainer 30 is removed from the cylinder body 13 after the slave cylinder 2 is incorporated into the vehicle body, the worker's hand is allowed to readily reach the connection piece 30*c*. The second lateral belt 30*d* is provided close to the rising base of the connection piece 30*c* from the vicinity of the base end of one coupling leg piece 30*b*. A cutout groove formed on the front end side of the second lateral belt 30*d* is used as a third engaging portion 30*j* and a cutout groove provided in abutment with the rising base of the other coupling leg piece 30*b* is used as a fourth engaging portion 30*k*.

As will be described later, the first retainer 30 is attached to the slave cylinder 2 by surrounding the cylinder body 13 with the first and second lateral belts 30*a* and 30*d*. The lengths of the first and second lateral belts 30*a* and 30*d* are predetermined and because the third engaging portion 30*j* joined to the fourth engaging portion 30*k* is formed so as to have a predetermined length in the longitudinal direction of the second lateral belt 30*d*, the first retainer 30 can widely be used even in the housing of any other actuator different in external diameter.

On the other hand, the second retainer 31 is formed by slightly curving a plate like ring body having a through-hole 31*a* whose diameter is slightly greater than the projected portion of the piston rod 25 and is smaller than an outer-end neck portion 25*b* in a manner conforming to the curved surface configuration of the outer end portion of the protective boot 26. A pair of reinforcing ribs 31*b* and 31*b* are arranged in a standing condition on the outer curved surface of the second retainer 31 with the through-hole 31*a* held therebetween. Thin stopper walls 31*c* and 31*c* arranged in a standing condition along the outer peripheral edge of the outer curved surface are used to couple both ends of the reinforcing ribs 31*b* and 31*b*. Semi-elliptic engaging grooves 31*d* and 31*d* are formed on the outer peripheral side of the second retainer 31 held between the reinforcing ribs 31*b* and 31*b* by cutting out the stopper walls 31*c* and 31*c*, the engaging groove 31*d* and the stopper wall 31*c* constituting a second engaging portion 31*e*.

A flange 13*b* is peripherally provided at the retractable side end of the piston rod 25 of the cylinder body 13 of the slave cylinder 2. The protruded engaging portions 13*a* and 13*a*, together with the first and second retainers 30 and 31, forming the holding means 10 are provided in the respective both side portions of the outside of the cylinder body 13 continuously to the flange 13*b*.

The holding means 10 is formed such that the second retainer 31 is held between the outer-end neck portion 25*b* of the piston rod 25 and the protective boot 26 before the piston rod 25 is incorporated into the slave cylinder 2 and that the first retainer 30 is attached to the retractable side of the piston rod 25 of the cylinder body 13 before the slave cylinder 2 is incorporated as the clutch piping system 11.

The first retainer 30 carries with its arm substantially half the perimeter on the lower retractable side of the piston rod 25 of the cylinder body 13 with the first lateral belt 30*a* so as to latch the folded portion between the first lateral belt 30*a* and the coupling leg pieces 30*b* and 30*b* onto the protruded engaging portions 13*a* and 13*a* of the cylinder body 13 whereby to make the coupling leg pieces 30*b* and 30*b* projecting the direction of the front end of the piston rod 25 along both sides of the protective boot 26. Further, the third engaging portion 30*j* is latched onto the fourth engaging portion 30*k* by bending the second lateral belt 30*d* in the direction of the cylinder body 13, so that the first and second retainers 30 and 31 can be fitted to the slave cylinder 2 by surrounding the vicinity of the retractable side end of the piston rod 25 of the cylinder body 13.

In this condition, the piston rod 25 of the slave cylinder 2 is kept projecting in a free condition by a return spring 32 freely extending within the hydraulic chamber 19 as shown by an imaginary line of FIG. 1.

Then the slave cylinder 2 above, together with the clutch master cylinder 1 and so forth, is incorporated as the clutch piping system 11 and the system 11 ranging from the reservoir 3 up to the slave cylinder 2 is filled with the clutch fluid to put the clutch piping system 11 in the pre-filled condition. The piston rod 25 of the slave cylinder 2 is forced into the cylinder bore 15 by means of the repulsive force of the return spring 32 against the clutch fluid. Moreover, the engaging shaft 30*i* of the first engaging portion 30*f* of the first retainer 30 is inserted into the engaging groove 31*d* of the second engaging portion 31*e* of the second retainer 31 to make the first stopper 30*g* cross the outside of the engaging groove 31*d* at right angles. The first and second retainers 30 and 31 are coupled together by clamping the second retainer 31 between the first and second stoppers. 30*g* and 30*h* of the first engaging portion 30*f*, whereby the retracted condition of the piston rod 25 is held (a solid line of FIG. 1, see FIGS. 2–6).

The slipping off of the first and second engaging portions 30*f* and 31*e* thus joined is regulated by bringing the first stopper 30*g* into contact with the stopper walls 31*c* and 31*c*. Further, the axial movement of the piston rod 25 is regulated by bringing the first and second stoppers 30*g* and 30*h* of the first engaging portion 30*f* into contact with the second retainer 31, whereby the axial movement of the piston rod 25 is regulated.

The clutch piping system 11 thus pre-filled with the clutch fluid is consigned to the vehicle assembly maker and incorporated into the engine chamber of the vehicle. The first retainer 30 of the holding means 10 is such that the connection piece 30*c* and the second lateral belt 30*d* are positioned on the upper side of the vehicle body and that the first lateral belt 30 and the rupture portion 30*e* are positioned on the lower side thereof in such a condition that the slave cylinder 2 has been incorporated into the engine chamber. When the worker picks up the connection piece 30*c* from above the engine chamber directly or with a proper tool, the rupture portion 30*e* of the first retainer 30 is pressed against the cylinder body 13 and torn off. Then the first lateral belt 30*a* is separated from the rupture portion 30*e* and opened in both lateral directions, so that the first retainer 30 is removed from the cylinder body 13 and lifted up.

The coupling leg pieces 30*b* and 30*b* of the first retainer 30 are twisted sideways because of force of traction from above and the stopper 30*g* of the first engaging portion 30*f* perpendicularly joined to the engaging groove 31*d* of the second engaging portion 31*e* goes beyond the stopper wall 31*c* while tilting and moreover the engaging shaft 30*i* of the first engaging portion 30*f* slips out of the engaging groove 31*d*, whereby the first engaging portion 30*f* is released from engaging with the second engaging portion 31*e*.

Thus, the first retainer 30 is removed from the slave cylinder 2, whereas the second retainer 31 released from engaging with the first retainer 30 is left on the piston rod 25 in that state. Moreover, the piston rod 25 left in the retracted condition causes the cylinder body 13 to project outside due to the repulsive force of the return spring 32 as well as the clutch fluid pressure and the outer-end head portion 25*a* of the piston rod 25 is brought into contact with the front end of the release fork 27.

According to this embodiment of the present invention, the holding means 10 is constituted of the protruded engaging portions 13*a* and 13*a* of the cylinder body 13 of the slave cylinder 2, the first retainer 30 attached to the cylinder body 13 and the second retainer 31 attached to the piston rod 25. Consequently, the retracted condition of the piston rod 25 is well maintained before the slave cylinder 2 is incorporated into the vehicle body, whereas the piston rod 25 can be extended into the operating condition by conveniently removing the first retainer 30 after the slave cylinder 2 is incorporated into the vehicle body.

Further, since the first retainer 30 of the holding means 10 is attached to the cylinder body 13 by making use of the protruded engaging portions 13*a* and 13*a*, the retainer 30 can be fitted in without being affected by the length of the cylinder body as in the conventional case and as long as the external diameter of the cylinder body is substantially the same, the retainer is applicable to a cylinder body different in configuration. Moreover, as the third engaging portion 30*j* of the second lateral belt 30*d* joined to the fourth engaging portion 30*k* is formed so as to have a margin in the longitudinal direction of the second lateral belt 30*d*, the retainer can widely be used for a cylinder body different in external diameter.

Therefore the first retainer 30, together with the second retainer 31 for general use, is still applicable to any other kind of cylinder body different in configuration in order to not only reduce the number of parts in such a holding means but also improve productivity, safekeeping capacity and economic efficiency.

Since the protruded engaging portions 13*a* and 13*a* of the cylinder body 13 are joined to the folded portion between the first lateral belt 30*a* and the coupling leg pieces 30*b* and 30*b*, the regular fitted condition of the first retainer 30 is well maintained without pivoting in the peripheral direction of the cylinder body and moving in the direction of the outer end of the piston rod at random. In particular, the work of removing the first retainer 30 can simply be done as the connection piece 30*c* is positioned on the upper side of the vehicle body.

Since the first retainer 30 is fitted to the vicinity of the retractable side of the piston rod of the cylinder body 13, the distance between the first and second retainers 30 and 31 is made shortest and the length of the coupling leg pieces 30*b* and 30*b* is reduced to a bare minimum. Therefore, the unnecessary motion of the first and second retainers 30 and 31 is restrained, whereby the piston rod 25 is effectively prevented from falling down, which results in reducing the cost as the material expenses are saved.

According to the present invention, the coupling leg piece may also be provided to the second retainer or to both the first and second retainers. Moreover, the number of coupling leg pieces can be three or greater. The protruded engaging portions of the housing of the actuator are mainly intended to regulate the movement of the first lateral belt of the first retainer in the direction of the outer end of the piston rod. This means it is not always needed to join the protruded engaging portions to the folded portion between the first lateral belt of the first retainer and the coupling leg pieces without space but allowed to provide some space therein.

The first and second lateral belts of the first retainer are only required to peripherally surround the housing of the actuator thereby and the length and shape of each lateral belt can be changed as occasion demands. Further, the first rupture portion may be omitted. In this case, the first retainer is to be removed from the housing by releasing the engaging of the second lateral belt. Moreover, the holding structure according to the present invention is usable for the clutch master cylinder and a brake master cylinder as well depending on the purpose.

As set forth above, the actuator holding structure for a vehicle according to the present invention is such that the retracted condition of the piston rod is well maintained before the actuator is incorporated into the vehicle and that the piston rod can be set to the operating condition in which the piston rod is extended and retracted by simply removing the first retainer after the actuator is incorporated into the vehicle.

Further, since the first retainer is attached to the cylinder body by making use of the protruded engaging portions of the housing, the first retainer can be fitted in without being affected so much by the length and configuration of the housing as in the conventional case and the first retainer is widely applicable to any other actuator whose housing is different in configuration. Therefore, together with the second retainer for general use, the number of parts in the first retainer becomes reducible and consequently it is possible to improve productivity, safekeeping capacity and economic efficiency.

Since the first retainer is fitted to the retractable side of the piston rod of the housing, the distance between the first and second retainers is made shorter and the length of the coupling leg pieces is reduced to a bare minimum. Therefore, the unnecessary motion of the first and second retainers is restrained, whereby the piston rod is effectively prevented from falling down, which results in reducing the cost as the material expenses are saved.

What is claimed is:

1. An actuator holding structure for a vehicle, holding a piston rod retractably contained in a housing of an actuator in such a manner that the piston rod is held in the housing in a retracted condition and while the actuator is in operation, the retracted condition of the piston rod is released so that the piston rod is allowed to be extended and retracted, comprising:

a first retainer attached to the housing;

a second retainer attached to the piston rod; and, a plurality of protruded engaging portions formed on the outer peripheral surface of the housing, wherein the piston rod is held in the retracted condition while the first retainer and the second retainer are engaging together, and when the first retainer is released from engaging with the second retainer, and the piston rod is allowed to be extended and retracted, wherein the first retainer includes a first lateral belt for peripherally holding a part of the housing by engaging with the protruded engaging portions while the first retainer and the second retainer are engaging together, and a second lateral belt for peripherally holding the other part of the housing opposite to the first lateral belt so as to be latched and unlatched.

2. The actuator holding structure for a vehicle as set forth in claim 1, wherein the first retainer is disposed in the vicinity of the retractable side of the piston rod of the housing, wherein a plurality of coupling leg pieces are projected from one of the first and second retainers, the coupling leg piece having a first engaging portion, whereas a second engaging portion for latching and unlatching the first engaging portion is provided to the other retainer.

3. The actuator holding structure for a vehicle as set forth in claim 1, wherein the first lateral belt includes a rupture portion for breaking apart the first retainer when the first retainer is removed.

4. The actuator holding structure for a vehicle as set forth in claim 2, wherein the first lateral belt includes a rupture portion for breaking apart the first retainer when the first retainer is removed.

5. The actuator holding structure for a vehicle as set forth in claim 1, wherein the first retainer includes a connection piece coupling both ends of the first lateral belt so as to keep the engaged condition of the second lateral belt when the first retainer is removed.

6. The actuator holding structure for a vehicle as set forth in claim 2, wherein the first retainer includes a connection piece coupling both ends of the first lateral belt so as to keep the engaged condition of the second lateral belt when the first retainer is removed.

7. The actuator holding structure for a vehicle as set forth in claim 3, wherein the first retainer includes a connection piece coupling both ends of the first lateral belt so as to keep the engaged condition of the second lateral belt when the first retainer is removed.

8. The actuator holding structure for a vehicle as set forth in claim 4, wherein the first retainer includes a connection piece coupling both ends of the first lateral belt so as to keep the engaged condition of the second lateral belt when the first retainer is removed.

* * * * *